US005784805A

United States Patent [19]

Hashimoto

[11] Patent Number: 5,784,805

[45] Date of Patent: Jul. 28, 1998

[54] WOOD TREATING APPARATUS

[75] Inventor: Yotaro Hashimoto, Shiga-ken, Japan

[73] Assignee: Eiwa Co., Ltd., Shiga-ken, Japan

[21] Appl. No.: 743,385

[22] Filed: Nov. 4, 1996

Related U.S. Application Data

[63] Continuation of Ser. No. 350,627, Dec. 7, 1994, abandoned, which is a continuation of Ser. No. 33,155, Mar. 16, 1993, abandoned.

[30] Foreign Application Priority Data

| | | | |
|---|---|---|---|
| Apr. 10, 1992 | [JP] | Japan | 4-089198 |
| Dec. 22, 1992 | [JP] | Japan | 4-342513 |
| Feb. 17, 1993 | [JP] | Japan | 5-028132 |

[51] Int. Cl.[6] ..... F26B 17/00

[52] U.S. Cl. ..... 34/589; 34/66; 34/76; 34/202; 34/210

[58] Field of Search ..... 34/589, 60, 61, 34/62, 66, 73, 76, 202, 210; 8/402; 118/407, 429, 715

[56] References Cited

U.S. PATENT DOCUMENTS

| | | | |
|---|---|---|---|
| 2,042,826 | 2/1936 | Bright | 8/402 |
| 2,435,218 | 2/1948 | Hudson | 34/470 |
| 4,567,115 | 1/1986 | Trumble | 428/514 |

FOREIGN PATENT DOCUMENTS

| | | |
|---|---|---|
| 49-116204 | 11/1974 | Japan . |
| 51-136803 | 11/1976 | Japan . |
| 61-37402 | 2/1986 | Japan . |
| 1-38641 | 8/1989 | Japan . |

*Primary Examiner*—Henry A. Bennett
*Assistant Examiner*—Steve Gravini
*Attorney, Agent, or Firm*—Knobbe, Martens, Olson & Bear, LLP

[57] ABSTRACT

A wood treating apparatus for efficiently treating wood with a chlorine-based organic solvent includes: a solvent tank storing a mixture of chlorine-based solvent and water, which solvent tank is provided with a heater for heating the mixture to generate vapor of chlorine-based solvent and water; a treating chamber for containing wood to be treated, which treating chamber receives the vapor from the solvent tank; and a cooling chamber contacting an upper portion of the treating chamber for cooling and condensing the vapor. The treated wood dries rapidly, and can uniformly be dyed.

14 Claims, 6 Drawing Sheets

WOOD TREATING APPARATUS

This application is a continuation of U.S. patent application No. 08/350,627, filed on Dec. 7, 1994 abandoned, which is a continuation of application Ser. No. 08/033,155 filed on Mar. 16, 1993 abandoned.

FIELD OF THE INVENTION

The present invention relates to a method for defatting, coloring, and drying wood. By the conventional method for treating wood by defatting, drying, and coloring, and so forth, it is difficult to melt out such parts of wood as cellulose, hemicellulose, and lignin, which compose its cell membranes. If an attempt was made to abruptly evaporate excess water in wood in a short time, the shape of wood would be notably altered, and it would become unsuitable to be processed into the designated wood products.

Therefore, it was only possible to perform this treatment by drying wood, taking such a long time as about one year and taking care not to alter the shape of wood. Enormous energy and time are expended for the work of drying wood, so that the quantity of treatable products is naturally limited. Furthermore, other problems have arisen Lignin itself is a material which is difficult to decompose or dissolve, its composition being not chemically clarified. When coloring wood, the dye permeates only to its thin surface layer.

Thus, whether wood is dried by the sun's heat or artificially, reducing the water content of wood to the saturation point of fibers can be relatively easily done by removing free water that is not confined in cells but the free water confined in the cell membranes which are tightly closed by lignin, lignin being a chemical component with high molecular phenols as its basic component material can hardly be removed.

After a tree has been felled, the poreholes of the false vessels and vessels of wood close, as if acting as valves, whereby the free water is confined within them. If the surface is abruptly dried while drying wood, the aforementioned poreholes of the false vessels and vessels close, acting as valves, whereby movement of free water content in lumens is stopped, bringing about a state in which the moisture remaining in the lumens does not evaporate, however high the temperature is raised thereafter, and a surface hardened state is reached.

As above-described, the wood, after the parent tree has been felled, undergoes the process of confining water content in its cells and lumens by means of lignin, etc. Accordingly, its water content can hardly be evaporated by drying by sun's heat or hot air, thus requiring a long time for drying.

In contrast, according to this invention, in order to draw out water content from the cell membranes firmly blocked by lignin, the unconfined free water is removed at first by blowing the wood with a vapor pressurized by heating of a chlorine base organic solvent for cleaning by vapor-defatting, like a methylene chloride ($CH_2Cl_2$) solvent. Thereafter, the fine molecules of the vapor of the methylene chloride ($CH_2Cl_2$) solvent melts the tough lignin in the cell structure, thereby perforating the cell membranes and undermining the valve action of the poreholes. In that way, outward movement of the confined free water through said perforations of the cells and said porehole valve parts is facilitated.

The perforations of the cells and the collapse of the valve action of the poreholes permit fine molecules of a dye to easily penetrate into the cell membranes, thereby enabling easy coloration deep into the interior of wood.

PRIOR ART

Heretofore, the techniques for subjecting wood to special treatments for improvements in putrefaction resistance, durability and designability, etc., while maintaining the proper properties of wood, are believed to be well known. They include such techniques as appear in Japanese Patent Laid-Open Nos. Sho 49-116204, 51-136803 and 61-37402 and Japanese Patent Publication No. Hei 1-38641.

SUMMARY OF THE INVENTION

The problem the present invention is to solve is as above-described. In the following, a means to solve said problem is defined. Thus in the wood treating work, a chlorine base organic solvent for cleaning by vapor-defatting is vaporized by heating said solvent to boil, to permeate its gas into the wood, thereby melting its oil and fat contents and consequently perforating its cell membranes.

The present invention provides a wood treating method which comprises adding water to a chlorine base organic solvent for cleaning by vapor-defatting and then heating the mixture to about 100°–103° C., to permeate steam and vapor of the chlorine base organic solvent for cleaning by vapor-defatting into the wood, thereby melting its oil and fat contents and consequently perforating its cell membranes, in the wood treating process.

It also provides a wood treating method which comprises hermetically sealing wood and a chlorine base organic solvent for cleaning by vapor-defatting in a pressure container, and then subjecting the container to compression by heating and decompression by cooling, thereby promoting the melting of the oil and fat components of the wood by the chlorine base organic solvent for cleaning by vapor-defatting, in the wood treating process.

The wood treating method further comprises drying the treated wood.

The wood treating method still further comprises coloring wood by permeating a fine grained dye thereinto.

DESCRIPTION OF THE PREFERRED EMBODIMENT

Figure 1:
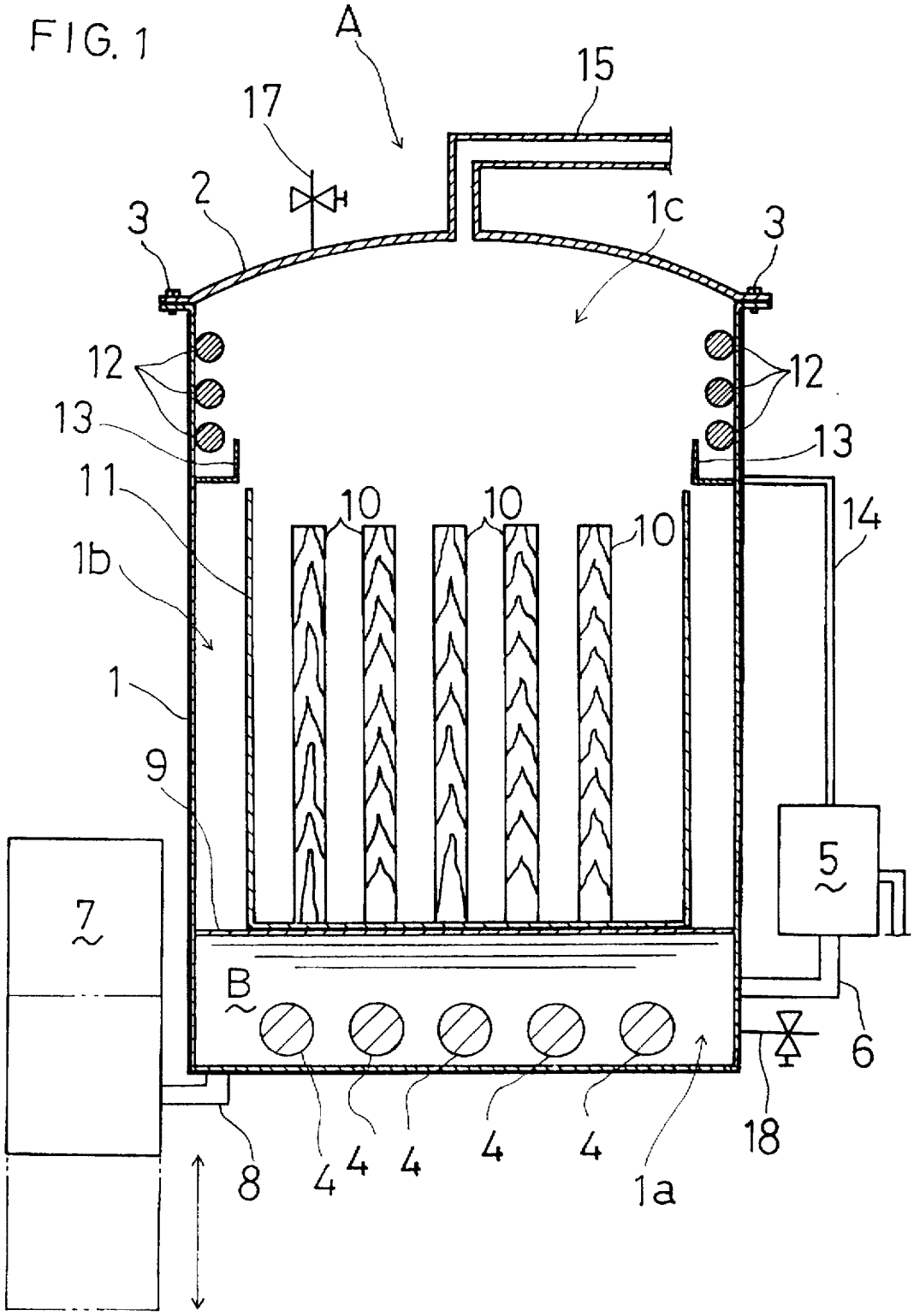
FIG. 1 is a front sectional view of a treating apparatus for use in performing the wood treating method of this invention.
Figure 2:
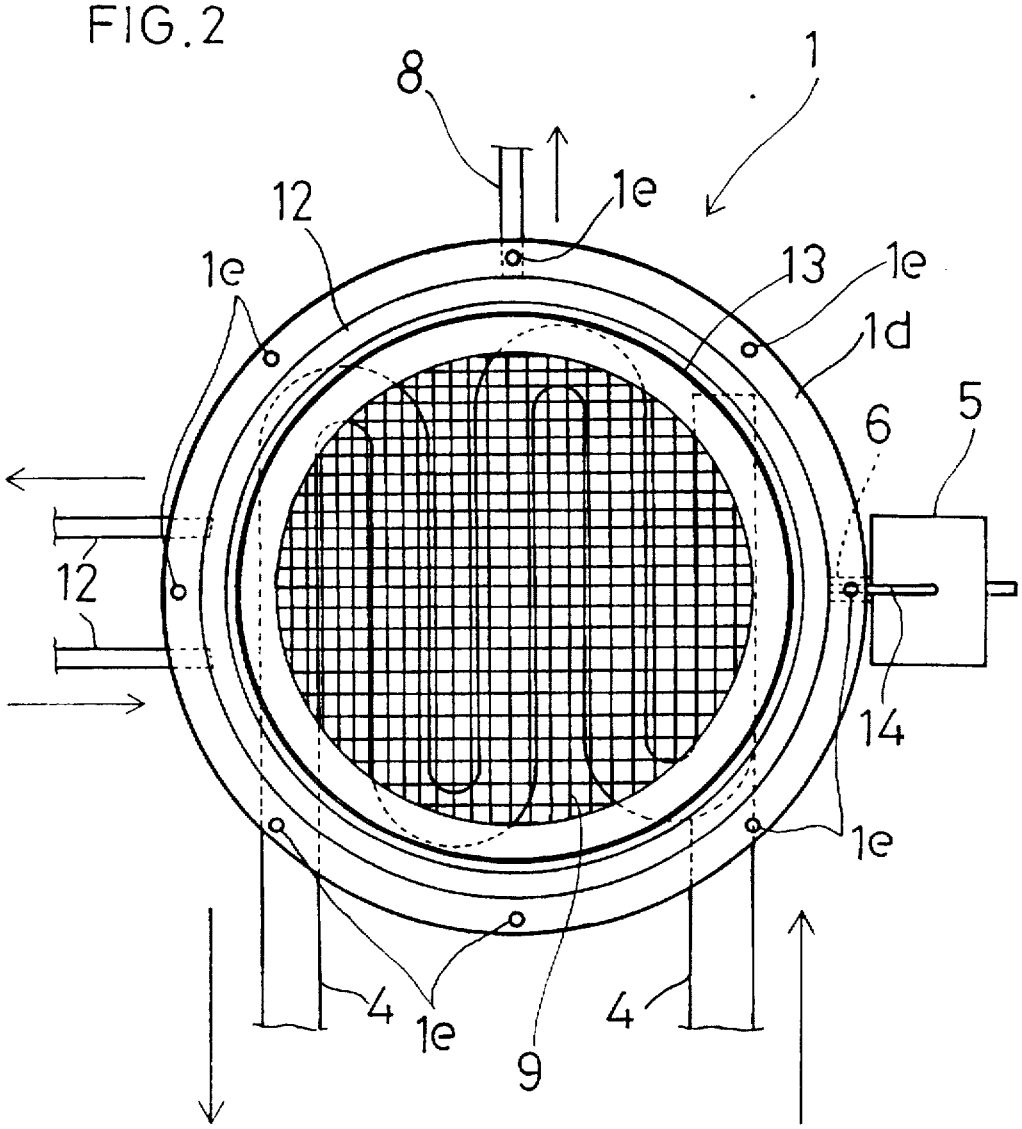
FIG. 2 is a plan view of the treating apparatus with its top cover removed for use in performing the wood treating method of this invention.

In reference to FIGS. 1 and 2, the composition of the treating apparatus for use in exercising the treating method of this invention is described. A wood treating pressure container A is made of stainless steel and is composed of a cylindrical body 1 and a dome shape top cover 2 placed thereon, said dome shape top cover 2 being mounted on the body 1 by screwing a plurality of closing bolts into a plurality of bolt holes 1*e*, 1*e*, . . . of a flange 1*d* located at the top of the body 1, and further the inside of the body 1 being composed of 3 compartments: a solvent tank 1*a*, a treating chamber 1*b* and a cooling chamber 1*c*.

The aforementioned solvent tank 1*a* is, as shown in FIGS. 1 and 2, arranged under a floor of the body 1 and is fully filled with a methylene chloride solvent B, being a chlorine base organic solvent for cleaning by vapor-defatting. Other organic solvents than methylene chloride ($CH_2Cl_2$) for cleaning by vapor-defatting are available, such as, trichloroethylene ($CHCl{=}CCl_2$), perchloroethylene ($CCl_2{=}CCl_2$), 1,1,1-trichloroethane ($CH_3CCl_3$) and flon 113 ($CCl_2FCC1F_2$), etc. In this embodiment, the methylene chloride ($CH_2Cl_2$) solvent B is used. A heat supply pipe 4 for heating said methylene chloride solvent B to boil is arranged from outside the tank for uniformly warming the whole of the tank interior. In addition, a solvent return pipe 6 is connected to the solvent tank 1*a* for returning into the solvent tank 1*a* the methylene chloride solvent B, which has been recovered by distillation at the cooling chamber 1*c* and then refined in a water separator 5. Also, a solvent drain pipe 8 is connected to the solvent tank 1*a* for draining the methylene chloride solvent B out of the solvent tank 1*a* after accomplishment of the first half of the treating operation, the solvent B then being stored in a solvent storage tank 7.

The aforementioned solvent tank 1*a* and the treating chamber 1*b* are partitioned by a drainboard floor 9. Inside said treating chamber 1*b*, the vapor of the methylene chloride solvent B, which has been heated to boil at a low temperature of about 40° C. in the solvent vapor layer C of methylene chloride. During the treating operation, a highly ventilative wood transport container 11 holding wood blocks to be treated 10 is mounted on the drainboard floor 9 of the treating chamber 1*b*. The methylene chloride ($CH_2Cl_2$) solvent B, which boils at about 40° C., may be readily vaporize and this vapor has the effect of defatting the oil and fat components of wood.

The cooling chamber 1*c* provided in such a way as to form a border D between air/vapor over the aforementioned treating chamber 1*b* is designed to recover by distillation the excess solvent vapor which has come up from the treating chamber 1*b* It is so composed that with the temperature of said cooling chamber 1*c* always preset not higher than 40° C., the B.P. of the methylene chloride solvent B, the vapor of the methylene chloride ($CH_2Cl_2$) solvent B coming up from the treating chamber 1*b* condenses there by means of cooling water, accumulates in a condensate and water receiving trough 13, is then fed through a condensate pipe to a water separator installed on one side of the body 1, to be refined, and returned to the solvent tank 1*a*.

Figure 3:
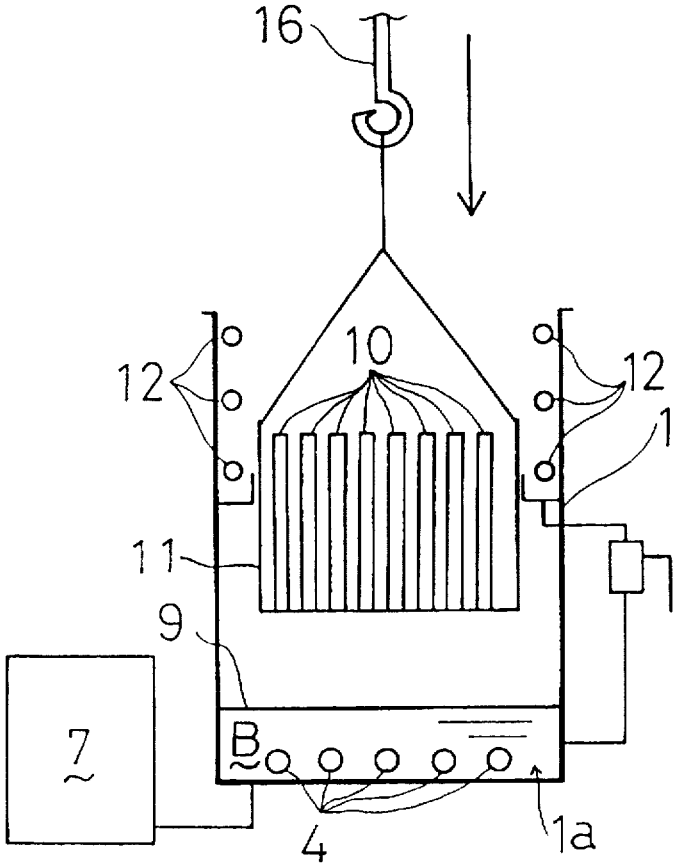
FIG. 3 is a schematic sectional view of the treating apparatus for use in performing the wood treating method of this invention, showing a preparation step for the treating work.

Referring to FIGS. 3 to 6, the treating work of this invention is described hereunder: first, as shown in FIG. 3, a wood transport container 11 holding the wood blocks to be treated 10 is carried in by a crane 16, to be mounted on the drainboard floor 9 inside the apparatus body 1 with the cover 2 of the wood treating pressure container A being removed.

Figure 4:
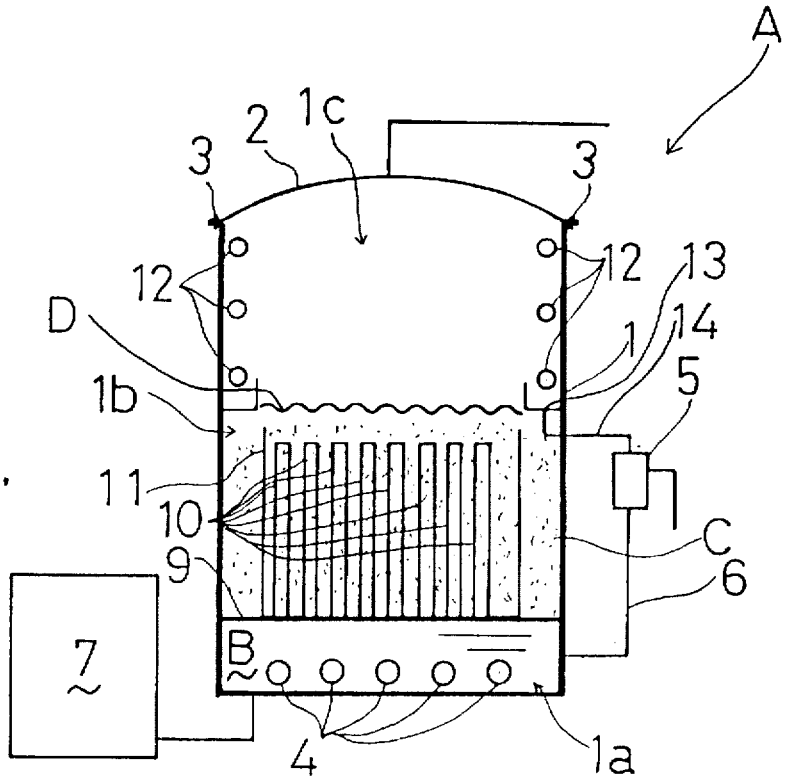
FIG. 4 is a schematic sectional view of the treating apparatus for use in performing the wood treating method of this invention, showing the treating work in progress.

Then as shown in FIG. 4, the top cover 2 is screw-fitted to the body by closing bolts, 3, 3, . . . , to hermetically seal the interior of the wood treating pressure container A. As the power switch for the heat supply pipe 4 is turned ON, the heat from the source is transmitted to the whole of the heat supply pipe interior, whereby the methylene chloride solvent B inside the solvent tank 1*a* is heated to boil, forming a solvent vapor layer C. Then the solvent vapor infiltrates into the interior of the wood blocks to be treated 10 in the wood transport container 11, which are immersed in said solvent vapor layer C. Then the free water not confined is thereby expelled out and the vapor melts the lignin which firmly blocks the cellulose and hemicellulose composing the cells of wood. This treatment work is continued for several hours. Then not only is the power switch for the heat supply pipe 4 turned OFF, but the methylene chloride solvent B inside the solvent tank 1*a*, which is no longer necessary for the latter half of the treatment work, is totally transferred into the solvent storage tank 7.

Figure 5:
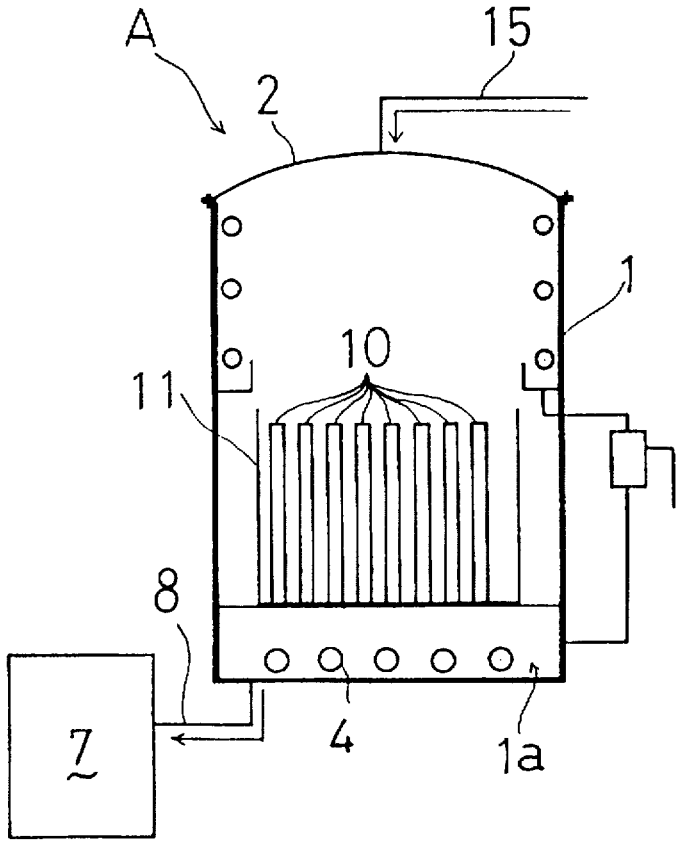
FIG. 5 is a schematic sectional view of the treating apparatus for use in performing the wood treating method of this invention, showing the treating work in progress.

By the above-mentioned treatment, the unconfined free water which is contained in the wood blocks to be treated 10 is expelled and the oil and fat components are melted, whereby the oil and fat components of wood are eluted by the methylene chloride ($CH_2Cl_2$) solvent B, together with its water content. As this defatting treatment has been accomplished, the oil and fat parts in the wood are dissolved out, bringing the wood into a state of its cells being perforated and the porehole valves being broken down. Next comes the work of reducing the water content to a predetermined value, as shown in FIG. 5.

In this operating example, the water content is reduced by hot air drying, but this may also be done by the sun's heat. In the case of hot air drying, the drying work of driving the water content out of the interior of the wood by means of hot air is carried out.

This drying work expels the solvent vapor which has infiltrated into the interior of the wood blocks to be treated 10 and drives out the confined free water through the perforated cells after oils and fats have been melted out and the porehole valve parts of the false vessels and vessels, etc. For this purpose, a hot air feed pipe 15 located on the top cover 2 is opened, to feed hot air into the interior of the wood treating pressure container A. By said hot air, the solvent and water content, which have infiltrated into the interior of the wood blocks to be treated 10, are evaporated and the free water, which has been confined inside the cells and in the false vessels and vessels, is also evaporated. By continuing this work for several hours, the solvent of methylene chloride and the confined free water can be completely evaporated from the interior of the treated wood blocks 10.

Figure 6:
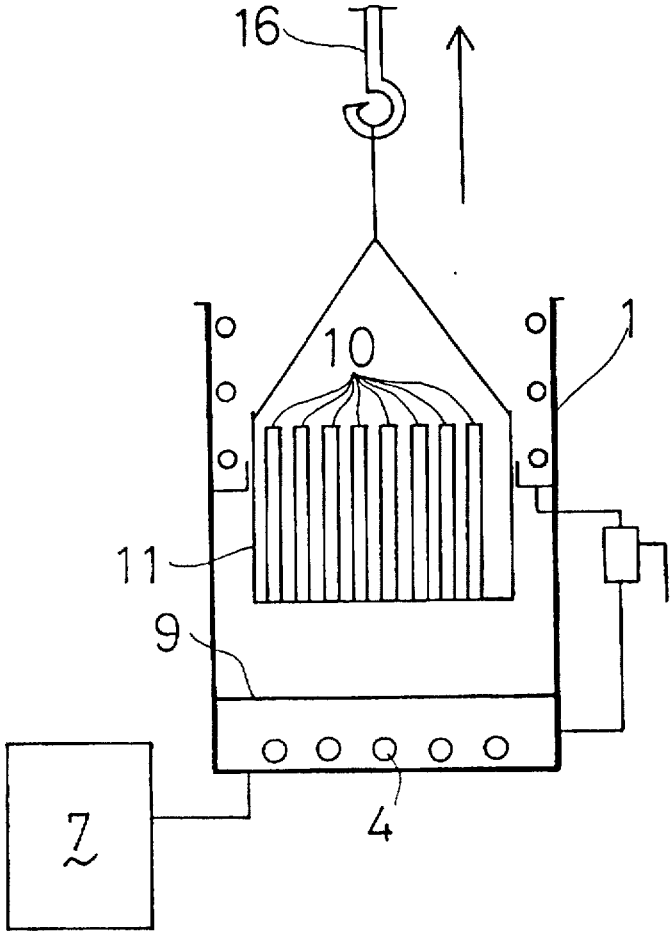
FIG. 6 is a schematic sectional view of the treating apparatus for use in performing the wood treating method of this invention after accomplishment of the treating work.

Upon completion of all treating works, the dome shape top cover 2 is again opened, as shown in FIG. 6, and then the wood transport container 11 is carried out of the wood treating pressure container A by means of a crane.

During the treating operation, as shown in FIG. 4, the solvent storage tank 7 is brought upward, to hold equal the level of the methylene chloride solvent B in the solvent tank 1*a* and the solvent storage tank 7. Upon completion of the first half of the treatment work, the solvent storage tank 7 is brought downward, to facilitate recovery of the methylene chloride solvent B from the solvent tank 1*a*. Then the solvent is recovered through a solvent drawing out pipe 8.

By this wood treating work, the wood is defatted by the methylene chloride solvent B, the tough lignin in the cell structure is melted, thereby perforating the cell membranes, and the porehole valves of the false vessels and vessels are broken down. In that way, the process of driving out the confined free water through said perforations and porehole valves is facilitated. Thereafter, the coloring of the wood is accomplished by infiltrating a fine grained dye through these perforations and poreholes, etc. In the conventional coloring method, the dye failed to penetrate into the interior of the wood because of its cells being firmly bound by lignin. In the method of this invention, as above-described, the methylene chloride solvent B melts out the tough lignin in the cell structure and undermines the valve action of the poreholes, to bring about a state which ensures easy fleeing of the confined water through said perforations and the porehole valves, thereby enabling coloring the wood with the same dye deep into its interior. The coloring operation with said dye may be performed by dipping in a dye bath the wood blocks which have been subjected to the defatting treatment, but it may also be permeated as a vapor, as above-described, with the fine grains of the dye mixed with the methylene chloride solvent B.

In the wood treating pressure container A of this invention, safety valves 17 and 18 are provided respectively on the top cover 2 and the solvent tank 1*a*, so that should an abnormal pressure develop in the interior of the wood treating pressure container A during the treating work, they would open to reduce the pressure, thereby keeping its inside pressure always constant. Also, according to this invention, the methylene chloride solvent B and the wood blocks to be treated 10 are hermetically sealed in the interior of the wood treating pressure container A and heated by a heat supply pipe 4 or otherwise heated by some heat source from outside, thereby to vaporize the methylene chloride solvent B at a rate of about 6 kg/cm$^2$. The supply of heat to the heat supply pipe 4 is suspended about 1 hour later, to return the methylene chloride solvent B to its aqueous solution and the pressure is lowered to about the atmospheric pressure. The operation of compression by heating for one hour and decompression by cooling for one hour is repeated several times, whereby the defatting treatment by the vapor of the methylene chloride solvent B may be further promoted.

When the methylene chloride solvent B only is put in the solvent tank 1*a* inside the wood treating pressure container A and evaporated by heating, it may be vaporized at about 40° C., but because the surfaces of the wood blocks to be treated 10 are hardened at the initial period of the wood treatment, penetration of methylene chloride solvent B into the cells is thwarted. To counter this situation, mixing about 90% of water with the methylene chloride solvent in the solvent tank 1*a* and then heating this mixture to 100°–140° C., thereby explosively vaporizing water and the methylene chloride solvent B, is effective.

Thus, by mixing steam and vapor of methylene chloride and permeating the mixture into the wood blocks to be treated 10, the cells of said surfaces of the wood blocks to be treated 10 are opened and through the openings, the vapor of the methylene chloride solvent B is permeated, whereby the effect of promoting the defatting treatment is achieved. When the wood blocks to be treated 10, after being defatted by the methylene chloride solvent B, are dried using hot air, their water content goes down to the equilibrium value in several hours, but even by drying them with the sun's heat, it takes only about 2 weeks to reduce the water content to the equilibrium value.

As the defatting work of wood has ended with use of the methylene chloride ($CH_2Cl_2$) solvent and water, the methylene chloride ($CH_2Cl_2$) solvent and water again return to liquid, but in addition, the oil and fat contents in the wood also remain in this liquid in a separated state. Accordingly, the liquid is in a separated state of 3 layers of water, oil and fat components and methylene chloride. Then the oil and fat components of wood may be physically separated, from which to obtain a natural resin material.

Since the present invention is composed as hereabove described, the following effects are achieved: The vapor of the methylene chloride ($CH_2Cl_2$) solvent B, a chlorine base organic solvent for cleaning by vapor-defatting, acts on the oil and fat components of wood to defat and melt them, thereby partly perforating the cells of wood which contain cell water and breaking down the porehole valves of the false vessels and vessels. In this way, fleeing of the free water contained therein, which was hitherto difficult to extract, and, conversely, penetration of dye are facilitated. Accordingly, this method drastically reduces the wood treating time from one year to several days, as compared with the conventional method, thus enabling large amount of wood to be treated with enormous savings in time and energy.

The wood after being treated, as compared with that before being treated, has a volume that has been expanded, rather than shrunk, and its strength is not reduced at all.

The methylene chloride solvent, a chlorine base organic solvent for cleaning by vapor-defatting which is used to realize a large cutback on the treatment time, is a highly safe chlorine base solvent which does not injure wood and, moreover, has a low B.P. of 40° C., so that even when feeding hot air into the interior of the wood treating apparatus as a finishing step of the treatment work, or when recovering it by distillation, time and energy are saved.

According to this invention, a fine grained dye is mixed with methylene chloride or loaded on the gas of methylene chloride, for said fine grained dye to be carried into the cells of wood. In this way, it has become possible to obtain a wood with a nearly uniform grain color. In the conventional coloring method, wood is colored by dipping in a bath of a molten dye, but the cell's defence is firm, with the wood's lignin remaining unmelted, thus permitting the dye to penetrate only to the surface, resulting in a colored layer. Therefore, if the surface of the wood was shaved or otherwise removed, the colored layer was stripped, exposing the former wood grain deprived of the effect of coloration. However, when as in the method of this invention, the wood is dyed, after defatting it with use of the methylene chloride solvent, a chlorine base organic solvent for cleaning by vapor-defatting, the coloration can be made deeper by letting the fine grained dye penetrate into the cells, thereby enabling the colored layer to remain even if the surface is shaved.

In this invention, "wood" contains "chip" for pulp industry.

I claim:

1. A wood treating apparatus, comprising:

a solvent tank which is filled with a mixture of chlorine-based solvent and water, said solvent tank including a heater for heating said mixture to generate vapor of said chlorine-based solvent and said water at the same time; and a chamber comprised of:

a treating compartment for containing wood to be treated, said treating compartment receiving said vapor of said chlorine-based solvent and water from said solvent tank, said treating compartment having an upper portion; and a cooling compartment arranged adjacent said treating compartment for cooling and condensing said vapor of said mixture.

2. A wood treating apparatus as defined in claim 1, wherein said chlorine base organic solvent is a methylene chloride solvent.

3. A wood treating apparatus as defined in claim 1, wherein said mixture of chlorine base solvent and water is heated to higher than 40 degrees centigrade to generate said vapor.

4. A wood treating apparatus as defined in claim 1, wherein said treating compartment further includes an inlet for loading and unloading said wood to be treated to and from said treating compartment.

5. A wood treating apparatus as defined in claim 1, wherein said solvent tank, said treating compartment and said cooling compartment are arranged continuously, and a wall which permits said vapor to pass through is provided between said solvent tank and said treating compartment.

6. A wood treating apparatus as defined in claim 1, wherein said cooling compartment includes means for returning said condensed mixture of said chlorine-based solvent and said water to said solvent tank.

7. A wood treating apparatus as defined in claim 1, wherein said wood to be treated is placed in a container for loading into and unloading from said treatment compartment.

8. A wood treatment as defined in claim 1, wherein said cooling compartment has a cover at the top thereof which is hermetically sealed to increase the pressure of said vapor of said chlorine-based solvent.

9. A wood treating apparatus as defined in claim 1 further including a hot air pipe for providing a hot air to said wood that has been treated by said vapor of said mixture to dry said wood.

10. A wood treating apparatus, comprising:

a solvent tank which is filled with a mixture of chlorine-based solvent and water, said solvent tank including a heater for heating said mixture to generate vapor of said chlorine-based solvent and said water at the same time;

a treating chamber for containing wood to be treated, said treating chamber receiving said vapor of said chlorine-based solvent and water from said solvent tank, said treating chamber having an upper portion;

a cooling chamber arranged adjacent said treating chamber for cooling and condensing said vapor of said mixture; and a hot air pipe for providing a hot air to said wood that has been treated by said vapor of said mixture to dry said wood.

11. A wood treating apparatus as defined in claim 10, wherein said treating chamber further includes an inlet for loading and unloading said wood to be treated to and from said treating chamber.

12. A wood treating apparatus as defined in claim 10, wherein said cooling chamber includes means for returning said condensed mixture of said chlorine-based solvent and said water to said solvent tank.

13. A wood treating apparatus as defined in claim 10, wherein said wood to be treated is placed in a container for loading into and unloading from said treatment chamber.

14. A wood treating apparatus as defined in claim 10, wherein said cooling chamber has a cover at the top thereof which is hermetically sealed to increase the pressure of said vapor of said chlorine-based solvent.

* * * * *